US005172165A

United States Patent [19]

Hatakeyama et al.

[11] Patent Number: 5,172,165

[45] Date of Patent: Dec. 15, 1992

[54] IMAGE FORMING APPARATUS

[75] Inventors: Takuya Hatakeyama, Tokyo; Michiro Koike, Kawasaki, both of Japan

[73] Assignee: Canon Kabushiki Kaisha, Tokyo, Japan

[21] Appl. No.: 572,385

[22] Filed: Aug. 27, 1990

[30] Foreign Application Priority Data

Aug. 29, 1989 [JP] Japan ..... 1-222096

[51] Int. Cl.[5] ..... G03G 21/00

[52] U.S. Cl. ..... 355/215; 118/645; 355/245; 355/326

[58] Field of Search ..... 118/657, 658, 645; 355/215, 245, 251, 252, 253, 326, 327

[56] References Cited

U.S. PATENT DOCUMENTS

| | | | |
|---|---|---|---|
| 3,930,850 | 1/1976 | Matsumoto et al. | 96/1 |
| 4,316,396 | 11/1982 | Uchida | 355/298 |
| 4,398,817 | 8/1983 | Nishimura et al. | 118/657 X |
| 4,800,411 | 1/1989 | Tanaka et al. | 355/298 |
| 4,982,242 | 1/1991 | Ishii et al. | 355/326 |

FOREIGN PATENT DOCUMENTS

| | | | |
|---|---|---|---|
| 58-134663 | 8/1983 | Japan . | |
| 58-219073 | 12/1983 | Japan . | |
| 60-120372 | 6/1985 | Japan . | |
| 0014665 | 1/1986 | Japan | 355/215 |
| 61-205965 | 9/1986 | Japan . | |

*Primary Examiner*—A. T. Grimley
*Assistant Examiner*—P. J. Stanzione
*Attorney, Agent, or Firm*—Fitzpatrick, Cella, Harper & Scinto

[57] ABSTRACT

An image forming apparatus includes an image bearing member; a system for forming a latent image on the image bearing member; a developing device for developing the latent image formed on the image bearing member, the developing device including plural developing units, and each of the developing units including a developer carrying member movable to carry thereon the developer to supply the developer to the image bearing member and a developer scatter preventing member at a position adjacent the developer carrying member; a driver for moving a selected one of the developing units to a predetermined position faced to the image carrying member; a device for positioning the selected developing unit to an operating position for a developing operation; a member which is contacted to or close to the scatter preventing member when the selected developing unit is placed at the operating position.

22 Claims, 8 Drawing Sheets

IMAGE FORMING APPARATUS

FIELD OF THE INVENTION AND RELATED ART

The present invention relates to an image forming apparatus such as an electrophotographic machine or an electrostatic recording machine, more particularly to an image forming apparatus provided with plural developing units.

Referring first to FIG. 1, there is shown an image forming apparatus in the form of a full-color electrophotographic copying machine provided with plural developing units, which has already been put into practice.

The copying machine has an image transfer drum for supporting on its peripheral surface a transfer sheet P by a gripper 5*a* and has a photosensitive drum 1 (image bearing member) above the transfer drum 5. It further includes a rotary type developing device 100 having a rotatable member supporting plural developing units 101Y, 101M, 101C and 101BK and a toner supplying device 200 having toner suppliers 201Y, 201M, 201C and 201BK for supplying the toner to the developing units 101Y, 101M, 101C and 101BK, respectively.

The photosensitive drum 1 and the rotary type developing device 100 disposed above the transfer drum 5 unintentionally constitute a source of toner scattering, and in addition, the carrier particles (iron powder) in the two component developer used are also scattered Therefore, the surface of the transfer drum 5 disposed below them easily catches the scattered toner and carrier particles The toner deposited on the surface of the transfer drum 5 results in contamination of the backside of the transfer sheet P a weakened electrostatic attraction force between the transfer sheet P and a transfer material carrying sheet 5*b* wrapped around the transfer drum 5. As a result, various troubles occur such as degradation of the image quality, sheet jam or decrease in the durability of an image fixing roller Therefore, it is desired to provide a device to collect the toner and carrier particles from the surface of the transfer drum 5 to maintain a clean surface.

In addition, the developing units rotate to take horizontal or reversed position by the rotation of the rotatable member, and therefore, the behavior of the developer is not stabilized, with the result of difficulty in the control of the T/C ratio (mixture ratio of the toner to the carrier) and therefore the difficulty in providing stabilized images FIG. 9 shows a full-color electrophotographic copying machine proposed to provide a solution to the above problems (U.S. Ser. No. 474,369).

In this copying machine, the developing units 101Y, 101M, 101C and 101BK are supported on a supporting member and are moved in a horizontal plane. The developing device 100 containing them is disposed below the photosensitive drum 1. Therefore, the copying machine is significantly different from the one shown in FIG. 11.

Because of the different structure, the source of toner or carrier scattering can be disposed below the image transfer device, so that the influence thereof to the transfer drum can be reduced. In addition, since the developing units are arranged on a line, the size of the apparatus can be reduced as compared with the rotatable member supporting them.

Furthermore, the developing units are not rotated, so that the behavior of the developer in the developing unit, and therefore, the resultant image are stabilized.

The copying machine having the developing device shown in FIG. 9 has various advantages, but involves a problem that the developer can scatter into the adjacent developing unit or units.

As will be understood from FIG. 10, the developing units 101 are disposed with small intervals between adjacent ones in order to prevents the increase of the developing unit movement speed and in order to reduce the size of the entire copying machine. When a certain developing unit is in the developing operation, the toner particles may scatter from a developer carrying member, that is, the developing sleeve of the developing unit, and the scattered toner particles can reach the developing sleeve of the adjacent developing unit and is deposited thereon. If this occurs, the color mixture occurs with the result of deterioration of the color reproducibility and the degraded image quality.

SUMMARY OF THE INVENTION

Accordingly, it is a principal object of the present invention to provide an image forming apparatus wherein the developer in the developing unit being operated for the development is prevented from scattering to the adjacent developing unit, so that the color mixture is prevented to improve the image quality in the color reproducibility and the color stabilization.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preferred embodiments of the present invention will be described in conjunction with the accompanying drawings.

Figure 2:
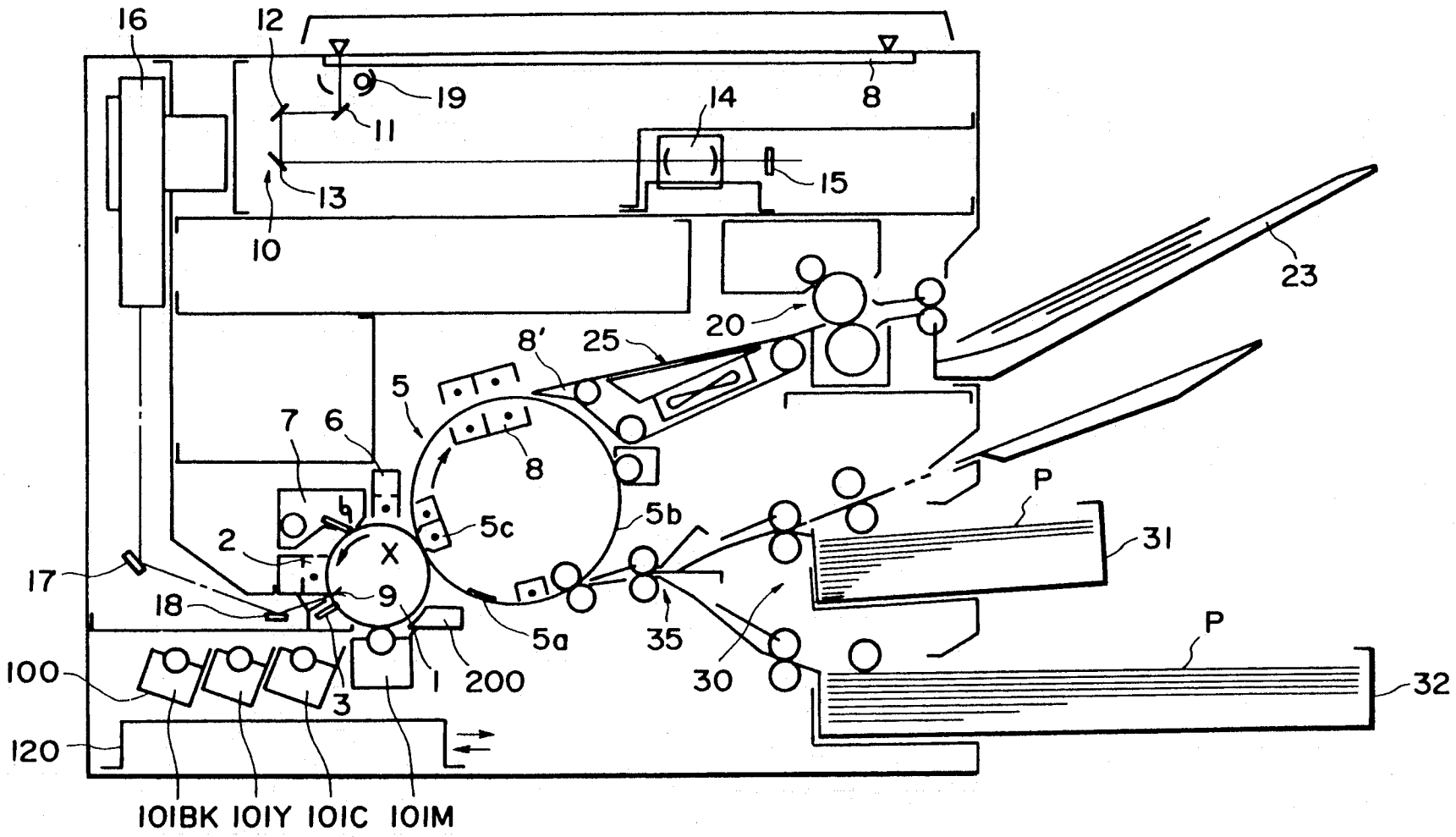
FIG. 2 is a sectional view of the image forming apparatus according to the embodiment.

FIG. 2 shows a full-color electrophotographic copying machine as an exemplary image forming apparatus according to an embodiment of the present invention.

The copying machine has an image bearing member in the form of a photosensitive drum rotatable in a direction indicated by an arrow x having a surface electrophotographic photosensitive layer, in this embodiment. The copying machine further comprises a primary charger 2 at the leftside of the photosensitive drum 1, a surface potentiometer 3 for measuring the surface potential of the photosensitive drum 1, a developing device 100 right below the photosensitive drum 1, a horizontally (left-right) movable developing device 100 right below the photosensitive drum 1, the developing device 100 having a plurality of developing units, namely, a developing unit 101M, a developing unit 101C, a developing unit 101Y and a developing unit 101BK, an image transfer device 5 at the upper right of the photosensitive drum 1, a pre-charger 6 for decreasing the deposition force between the photosensitive drum and the residual toner remaining on the surface of the photosensitive drum 1 after the image transfer to make the cleaning operation easier, at a position right above the photosensitive drum 1, and a cleaning device 7 at upper left of the photosensitive drum 1.

At the upper position, there is an optical system 10 to project light information corresponding to the image of the original on the platen 8 onto the photosensitive drum 1 at an image exposure station 9 between the primary charger 2 and the surface potentiometer 3. The optical system 10 may be of any type, and in this embodiment, it comprises a first scanning mirror 11, second and third scanning mirrors 12 and 13 movable in the same direction as the first scanning mirror 11 and and at a speed which is one half that of the first scanning mirror, an imaging lens 14, a CCD 15 integral with B, G and R filters, a laser scanner unit 12 and fixed mirrors 17 and 18. The scanner unit 16 is of a known type which deflects the laser beam by a polygonal mirror, and the detailed description thereof is omitted for simplicity.

In the optical system 10, the light source 19 for illuminating the original moves together with the first scanning mirror 11. Therefore, the reflected light image of the original scanned by the first, second and third scanning mirrors 11, 12 and 13 is passed through the lens 14 and is color-separated by the CCD 15 having B-G-R color separation filter, and is converted into electric signals. The original image information signals are subjected to the image information process including analog-digital conversion or the like, and are supplied to a microprocessor unit (MPU) controlling the entire copying machine, as video signals. The MPU responsive to the signals oscillates a laser beam from the laser unit through the laser driver, and the laser beam thus generated is projected on the photosensitive drum 1 while being imagewisely rendered on and off, thus starting the copy sequential operation.

To the right of the copying machine in this embodiment, there are an image fixing device 20 and a sheet feeding device 30. Between the transfer drum 5 and the fixing device 20 and between the transfer drum 5 and the sheet feeding device 30, there are transfer sheet conveying systems 25 and 35.

With this structure, the photosensitive drum 1 is subjected to the charging, image exposure, developing, image transfer and cleaning operations by the primary charger 2, the optical system 10 and the scanner unit 16, the developing device 100, the transfer device 5 and the cleaning device 7, for the respective color components into which the image is separated by the CCD 15.

Figure 3:
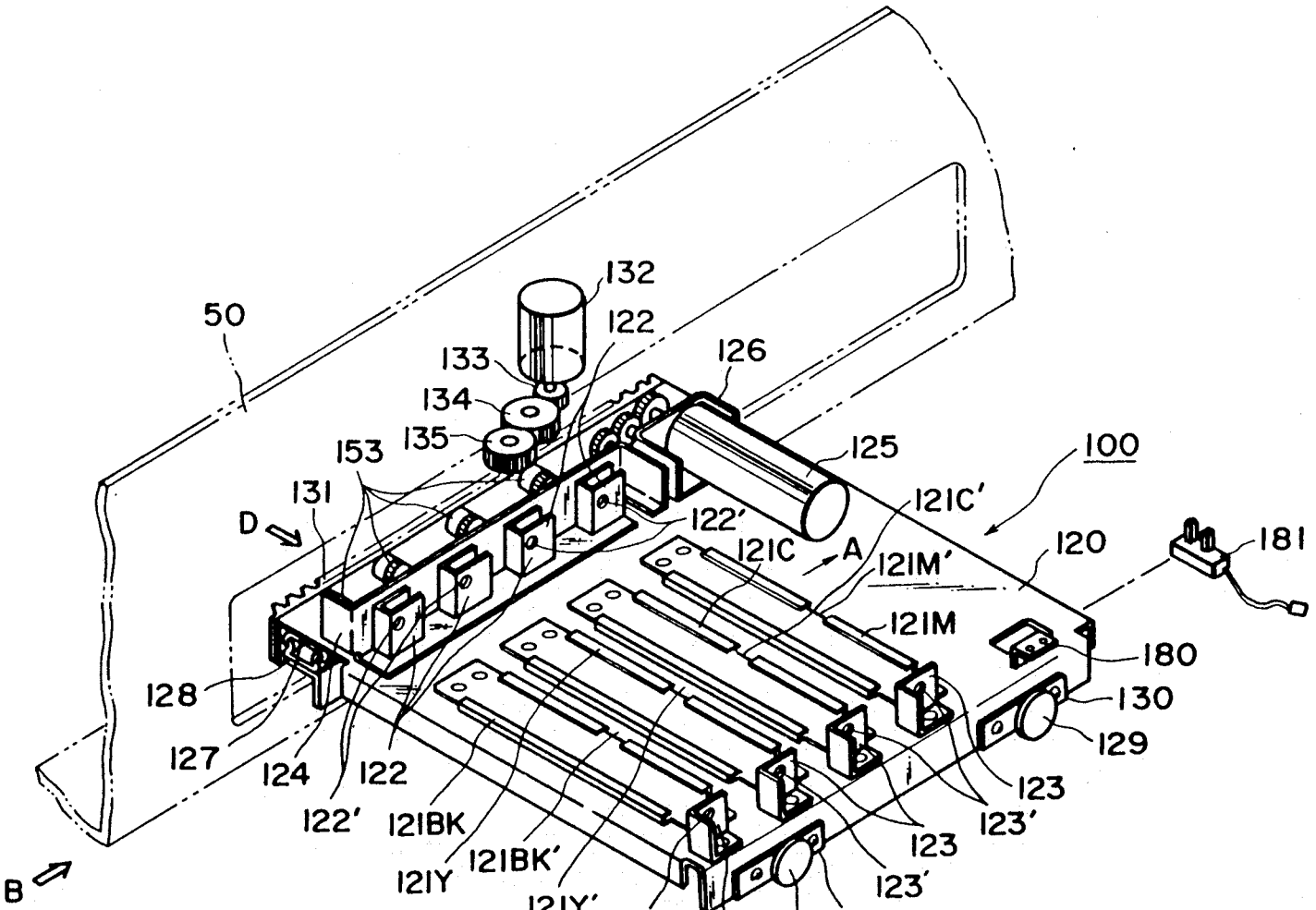
FIG. 3 is a perspective view of a movable base of the horizontal movement type developing apparatus.

The developing device 100, which will be described in detail hereinafter has the developing units 101M (magenta developing unit), 101C (cyan developing unit), 101Y (yellow developing unit) and 101BK (black developing unit), detachably mounted on a movable table 120 (FIG. 3). They function to develop the respective color separated components.

The transfer device 5 is typically provided with a transfer drum **5*b* having a gripper 5*a* for gripping the transfer sheet P (image receiving member) on the periphery thereof. The transfer device 5 catches the leading edge of the transfer sheet P fed through the transfer sheet conveying system 35 from the transfer sheet cassette 31 or 32 of the feeding device 30, and carries by the rotation thereof for transferring the respective color images from the photosensitive drum 1 to the transfer sheet carried thereon. In the image transfer zone, a transfer charger 5*c* is disposed inside the transfer drum 5. In this embodiment, the transfer sheet P is caught by the gripper, but this is not limiting, and it is possible that the transfer sheet P is electrostatically attracted on the transfer sheet carrying sheet 5*b*** by electrostatic attracting means.

After the respective visualized images, namely, the toner images are sequentially transferred onto the transfer sheet P, the transfer sheet P is released from the gripper **5*a*, and is separated from the transfer material carrying sheet 5*b* of the transfer drum 5 by the separation charger 8 and the separation pawl 8'. Then, the transfer sheet P is conveyed to the image fixing device 20 by the transfer material conveying system 25. The toner image on the transfer sheet P is fixed on the transfer sheet by the fixing device 20, and the transfer sheet P is discharged to the tray 23**.

The description will be made as to the developing device 100 according to this embodiment. The developing device 100 is reciprocable in a horizontal plane, namely left-right direction in the Figure. Each of the developing units is capable of being presented close to the photosensitive drum 1 right below the photosensitive drum 1 with a predetermined clearance. It is desired that each of the developing units is away from the photosensitive drum 1 when it is not at the developing position. Otherwise, when all of the developing units are moved in the vicinity of the photosensitive drum 1, all the developing units are close to the photosensitive drum 1 even when they are returned to the original position (home position) after the developing operations for the four colors are completed. Then, the toner erected on the developer carrying member, that is, the developing sleeve of each of the developing units is contacted to the photosensitive drum, with the result that the unnecessary toner is deposited on the photosensitive drum.

When the unnecessary toner is deposited on the photosensitive drum, the toner is entirely or partly transferred onto the transfer drum 5 to contaminate the transfer drum 5.

Adjacent to the developing operation position for the photosensitive drum 1, there are disposed the surface potentiometer 3 and a baffle plate to prevent the foreign matter such as paper dust onto the developing sleeve of each of the developing units from the above. In order to maintain the predetermined clearance between the developing sleeve and such elements without contact therebetween, each of the developing units is desired to be away from the photosensitive drum 1 when the developing operation is not performed.

The developing device 100 movable in the horizontal plane according to the present invention is such that each of the developing units is in the vicinity of the photosensitive drum 1 only during its developing operation when it is right below the photosensitive drum 1, and otherwise, it is away from the photosensitive drum 1.

Figure 4:
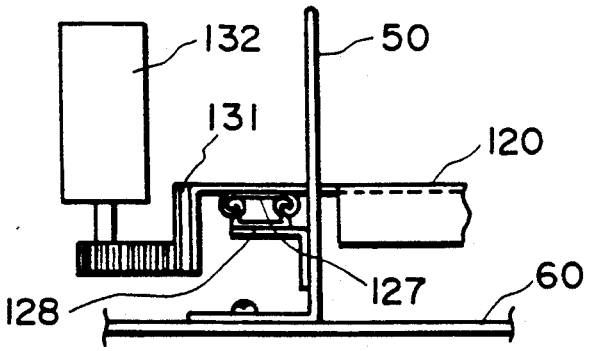
FIG. 4 is a partial side view of the movable base seen in a direction B of FIG. 3.
Figure 5:
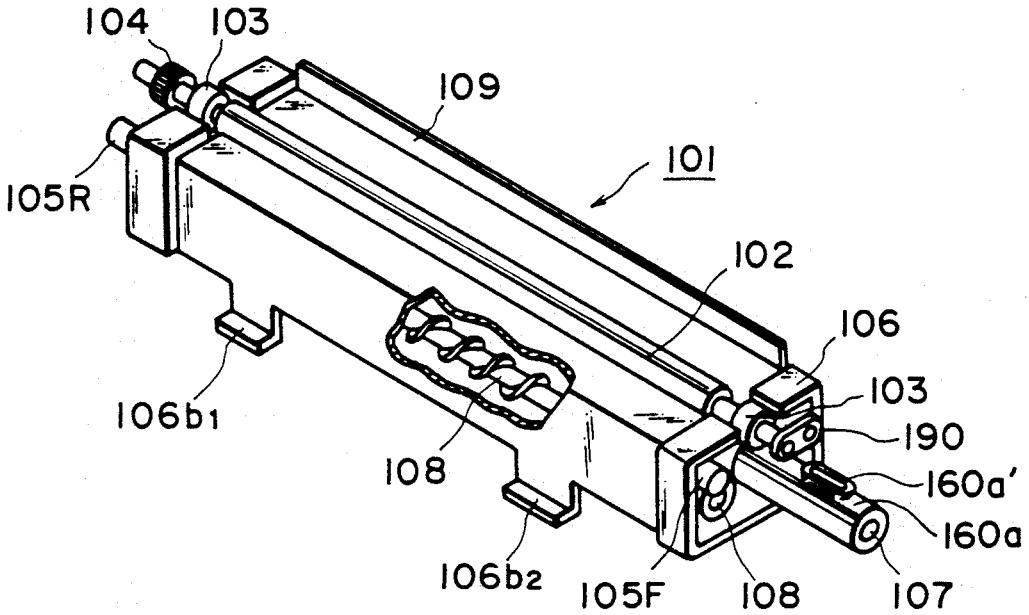
FIG. 5 is a perspective view of a developing unit.

Referring to FIGS. 3–5, the developing device 100 will be described in further detail. In this embodiment, the developing units 101 (101M, 101C, 101Y and 101BK) have the same structure, but the colors of the developers therein are different.

Referring to FIG. 5, the developing unit has an elongated developer container 106 having a rectangular cross-section. In the developer container 106, a developing sleeve 102 having therein a magnet is rotatably supported. At the longitudinal opposite ends of the developing sleeve 102, there are mounted rollers 103 for maintaining predetermined clearances from the photosensitive drum 1. To one of the longitudinal ends of the developing sleeve 102, a driving gear 104 for driving the developing sleeve 102 is mounted to transmit the driving source from a motor 125 (FIG. 3) through a drive transmission system (not shown) to the developing sleeve 102.

The magnet within the developing sleeve 102 is correctly positioned in the developing sleeve 102 by a positioning plate 190 disposed at the other longitudinal end of the developing sleeve.

At the opposite ends of the developer container 106, there are supporting shafts 105F and 105R coaxially in parallel with the axis of the developing sleeve 102. The supporting shafts are effective to position and mount the developing units 101 on the movable table 120 (FIG. 3) which will be described hereinafter. Within the developer container 106, there are screws 107 and 108 (only the shafts thereof are shown) for stirring and conveying the developer in the container. The screws 107 and 108 are driven through the gear train (not shown) by the driving gear 104 of the developing sleeve 102. One of the screws (that is, the screw 107 in this embodiment is projected to the front side from the developer container 106 at its one end, and the projected portion is connected with a conveying pipe 160 which is in turn connected with a toner supplier (not shown) above the conveying pipe 160, an elongated supply port 106*a*′ is formed for connection with the toner supplier. On one side wall of the developing unit, a developer scatter preventing member 109 is mounted, which projects upwardly from the developing unit 101.

Figure 1:
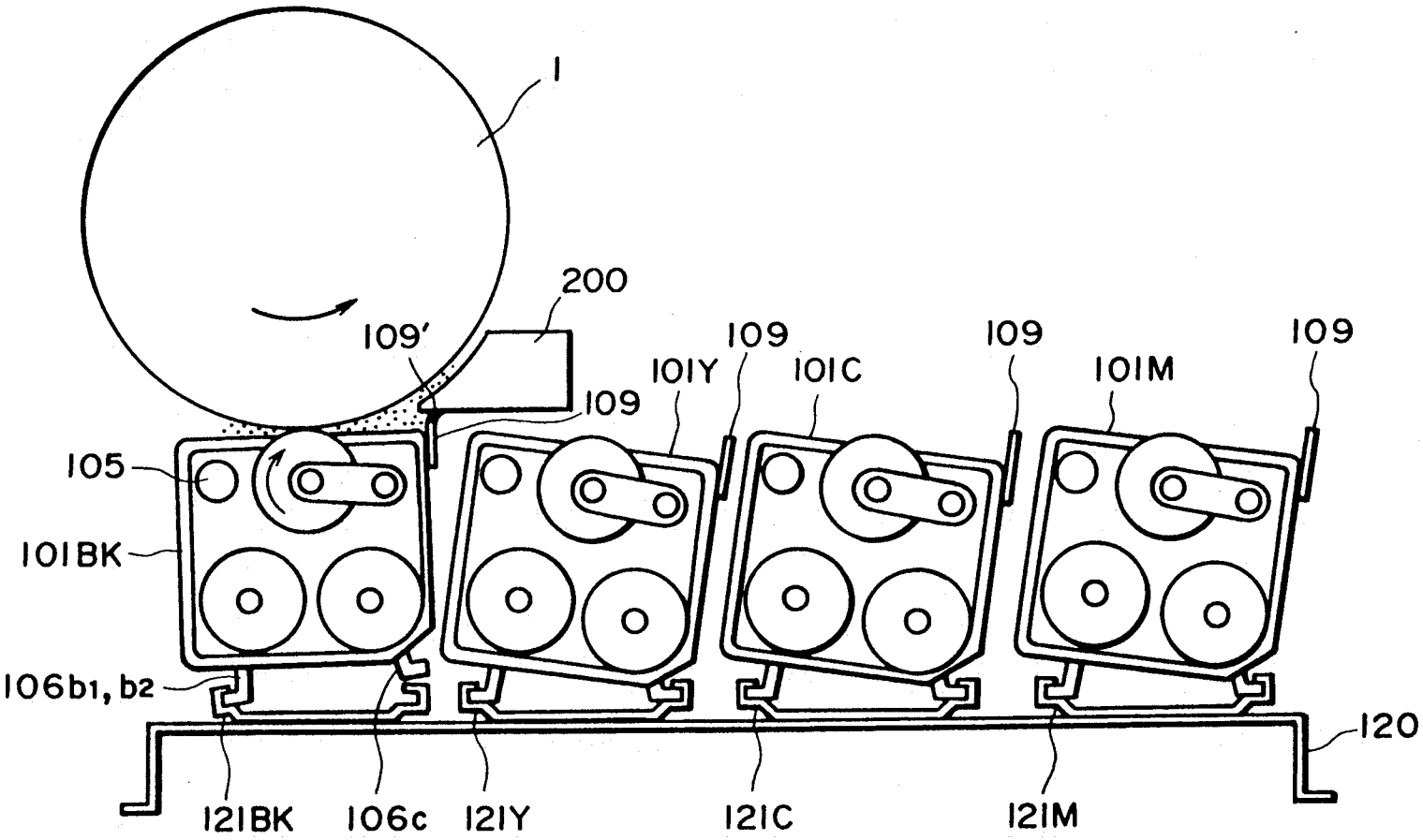
FIG. 1 is a sectional view of a developing apparatus of a horizontal movement type used with an image forming apparatus according to an embodiment of the present invention.

The bottom of the developer container 106 is provided with guiding legs 106*b* (106*b*1 and 106*b*2), 106*c* (FIGS. 5 and 1). The guiding legs are slidably engageable with a slide guide 121 mounted on the movable table which will be described hereinafter.

FIG. 3 is a perspective view of the entire developing device 100 of the copying machine from the front, left and upper position. In this Figure, each of the developing units 101 are omitted for the better understanding.

The developing device 100 has the movable table 120 for carrying the developing units 101. The movable table 120 is provided with the slide guide 121 (121M, 121C, 121Y and 121BK) mounted thereto by screws. The slide guide 121 is engageable with the guiding legs 106*b* and 106*c* of the associated developing unit. It is slidable in the direction indicated by an arrow A.

The movable table 120 has a rear supporting plate 122 and a front supporting plate 123 corresponding to each of the slide guides 121. The rear supporting plate 122 has an opening engageable with the rotational shaft 105R of the developing unit 101, and the front supporting plate 123 has an opening 123′ engageable with the rotational shaft 105F of the developing unit 101. After the developing unit 101 is inserted along the slide guide 121, and then the shaft 105R is engaged with the opening 123′ of the rear supporting plate 122, the shaft 105F is engaged with the opening 123′ of the front supporting plate 123, and thereafter, the front supporting plate 123 is mounted by screws to the base table.

Here, the openings 122′ and 123′ of the rear supporting plate 122 and the front supporting plate 123 in each of the developing units are adjusted using proper tools so that they have the common axis in parallel with the axis of the photosensitive drum 1, in the assembling.

In this embodiment, the rear supporting plate 122 is mounted by screws on the drive base plate 124 supporting the driving gears and the clutch or the like, the drive base plate 124 is mounted by screws on the base table 120. On the base table 120, a supporting plate 120 is mounted by screws, the supporting plate 126 supporting a DC motor 125.

Referring also to FIG. 4, the movable base table 120 is provided with a rail 127 at its rear end. The rail 127 is slidably engaged with a rail supporting table 128 mounted on a rear plate 50 fixed on a bottom plate 60 of the copying machine. On the other hand, to the front end of the base table 120, a roller 129 is rotatably supported through a supporting plate 130. The roller 120 has a bearing therein. The roller 129 is capable of rolling on the base plate 60.

With the above structures, the movable base table 120 is movable relative to the base plate 60 and the rear plate 50.

The driving of the movable table 120 is accomplished by transmitting the driving force of a stepping motor 132 mounted on the bottom plate 60 by an unshown supporting means to a lack 131 fixedly mounted on the base table 120 through a gear train mounted on the supporting means and comprising the gears 133, 134 and 135.

In this embodiment, the developing device 100 is horizontally moved substantially in a tangential direction of the photosensitive drum to the photosensitive drum 1 together with the base table 120, so that a selected one of the developing units is moved to the position substantially right below the photosensitive drum 1, and then, it is raised toward the photosensitive drum 1 and fixed at the operating position with a predetermined clearance from the photosensitive drum 1. The urging mechanism for displacing the developing device 100 toward the photosensitive drum, that is, the raising mechanism, itself does not constitute a part of the present invention (U.S. Ser. No. 474,369), and therefore, the detailed description is omitted. However, the movement of the developing device 100 will be briefly described referring to FIG. 1.

Figure 6:
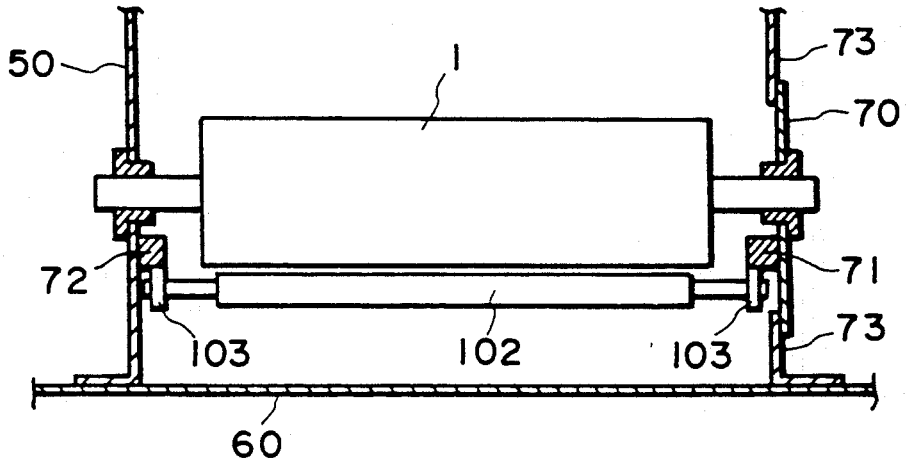
FIG. 6 is a front sectional view illustrating the developing unit at its upper position.

When the desired developing unit, black developing unit 101BK, for example, reaches the position right below the photosensitive drum 1 by the movement of the movable base table 120, the developing unit guide (121BK in this example) for the developing unit slides to the right relative to the movable table 120 by the raising mechanism, by which the developing unit 101BK is rotated about the rotational axis 105 connecting the supporting shafts 105F and 105R, so that the developing sleeve 102 is displaced toward the photosensitive drum 1. At this time, referring to FIG. 6 which is a sectional view of the copying machine, the abutment rollers, 103, spacer means, are press-contacted with a predetermined pressure to the abutment members 71 and 72 properly mounted by tools at the position in relation to the surface of the photosensitive drum 1, by which the developing sleeve 102 is maintained close to the photosensitive drum 1 with the predetermined clearance maintained therebetween.

According to this embodiment, as best seen in FIG. 1, each of the developing units is provided with the developer scatter preventing member 109. The preventing member 109 is made of urethane sheet having a thickness of 200 microns, for example. As also shown in FIG. 5, it is attached to the developer container 106 at its entire length.

Above the developer container 106, an abutment member 200 is provided which is close to the photosensitive drum 1 such that an end surface of the preventing member 109 is slightly contacted.

With this structure, when the developing unit is rotated and raised, and the developing operation is effected at the developing position (the black developing unit 101BK is in the developing operation in FIG. 1), a closed space is defined by the developing sleeve 102, the photosensitive drum 1, the developer scatter preventing member 109 and the abutment member 200 downstream of the developing sleeve 102. Therefore, the scattered developer if any is confined in the closed space at the downstream (right side in FIG. 1) with respect to the rotational direction of the developing sleeve.

In this embodiment, the developer scatter preventing member 109 is disposed only at the downstream side. Generally, the air flow around the developing sleeve is toward the downstream, and the developer scatters more to the downstream. Therefore, the scattering of the developer can be effectively suppressed by providing the developer scatter preventing member 109 only at the downstream side as in this embodiment. Therefore, the prevention of the color mixture is very significant.

In the example of FIG. 1, the developing unit is raised by the rotational movement, and therefore, the preventing member 109 is provided only at one side, but it is further preferable that it is provided at each of the sides of the developing sleeve.

Figure 7:
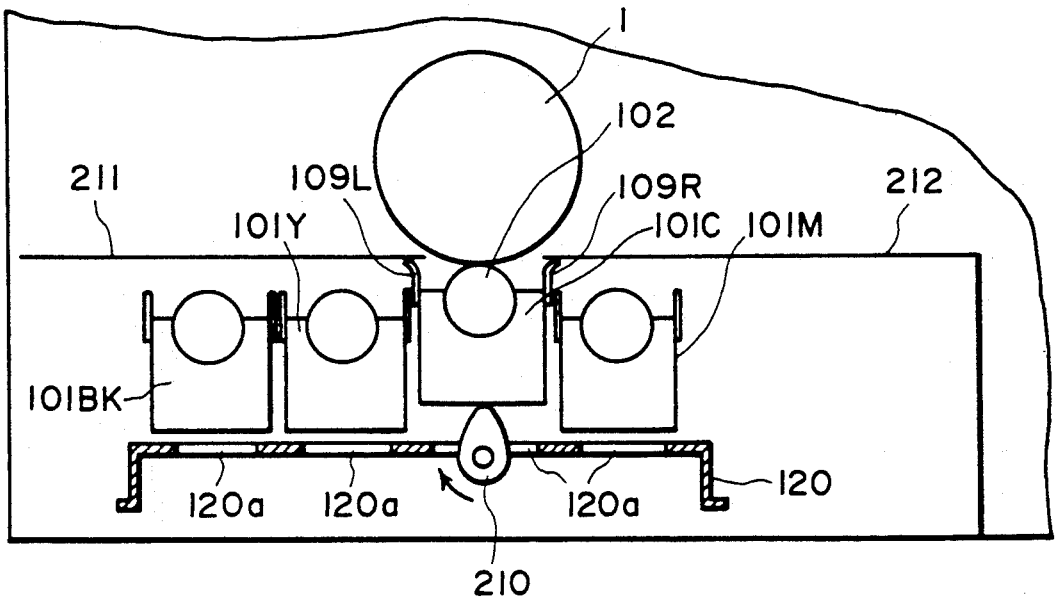
FIG. 7 is a sectional view of a horizontal movement type developing apparatus used with an image forming apparatus according to another embodiment of the present invention.

Referring to FIG. 7, another embodiment will be described wherein the developing units 101M, 101C, 101Y and 101BK are translated upwardly and downwardly with the horizontal position thereof maintained by an unshown guiding mechanism. A raising cam 210 is supported on the main assembly of the apparatus for rotation in the indicated direction and disposed for contact to the bottom of the developing unit through an opening **120*a* formed in the movable table 120. By the cam 210, each of the developing units can be moved toward the photosensitive drum 1 at the developing position. Therefore, in this embodiment, the developer scatter preventing members 109R and 109L can be provided at both sides of the developing sleeve 102. As shown in FIG. 7, it is possible that partition walls 211 and 212 provided at the upper positions of the developing device are used as abutment members, and the developer scatter preventing members are contacted to the partition walls 211 and 212**. The abutment members will suffice if the preventing members are contactable thereto, and may be any members.

In the embodiment described in conjunction with FIG. 1, the developer scatter preventing member is made of urethane sheet, but the usable materials include a Myler sheet, rubber sheet. It is not limited to the sheet material, and any properly shaped elastic member such as moltplane is usable.

Figure 8:
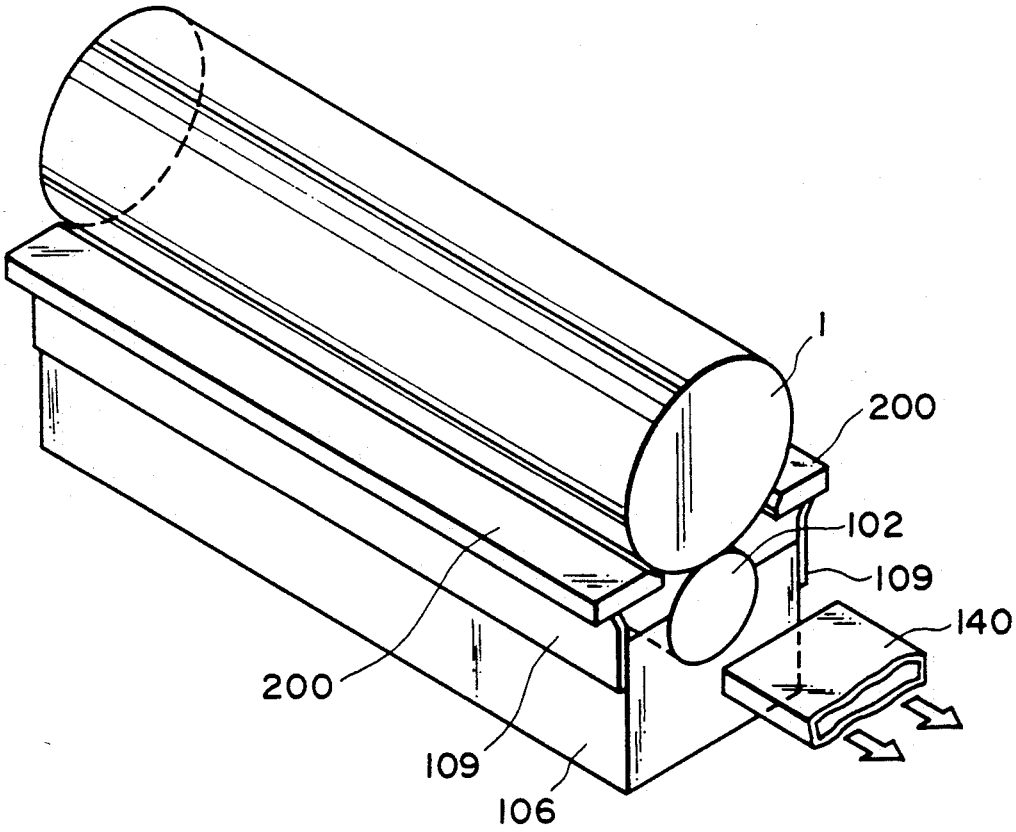
FIG. 8 is a perspective view of a major part of developer scatter preventing means according to another embodiment.
Figure 9:
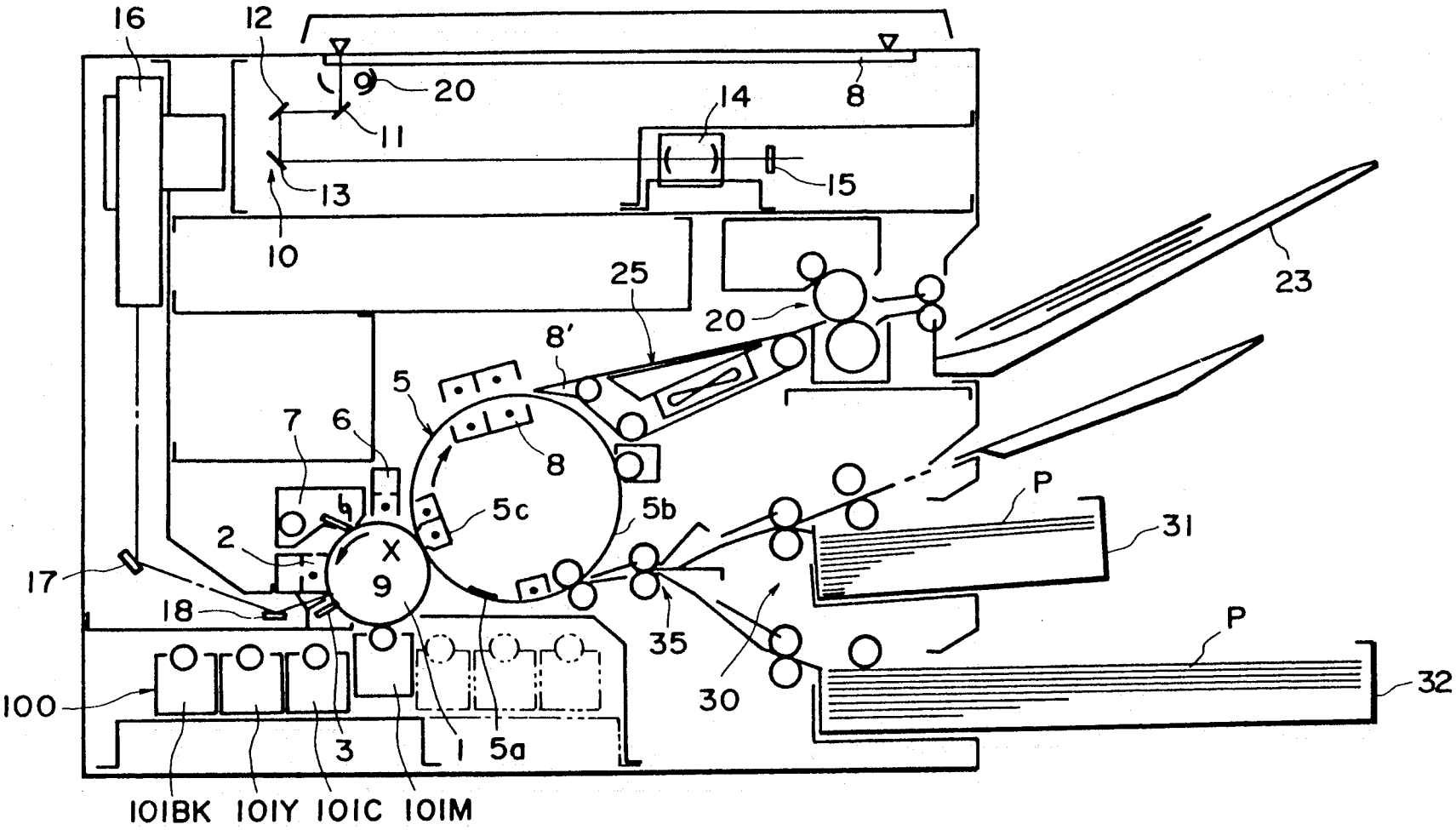
FIG. 9 is a sectional view of a full-color copying machine provided with a horizontal movement type developing machine which has already been proposed.
Figure 10:
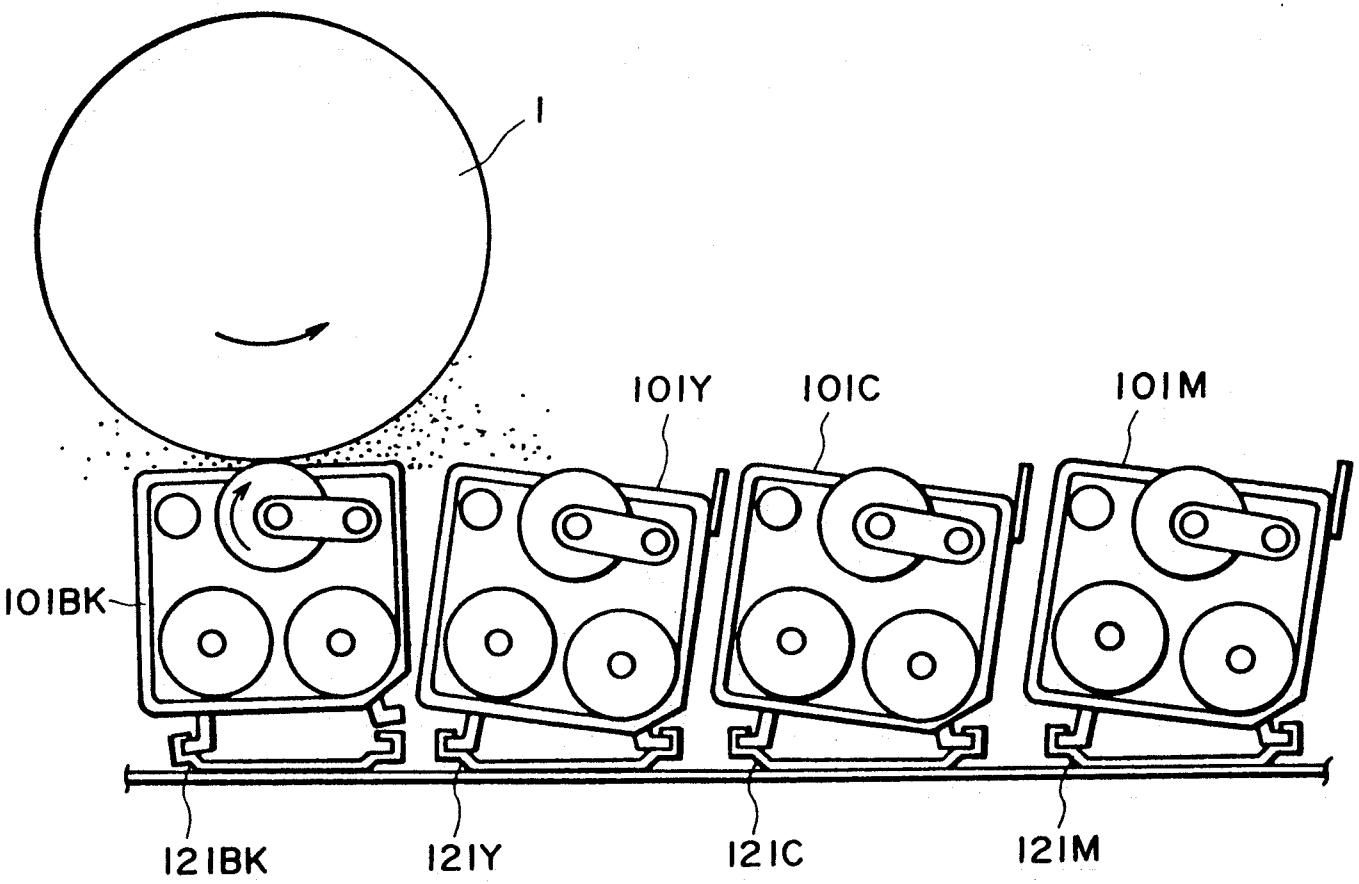
FIG. 10 is a side view of the developing apparatus of FIG. 9.
Figure 11:
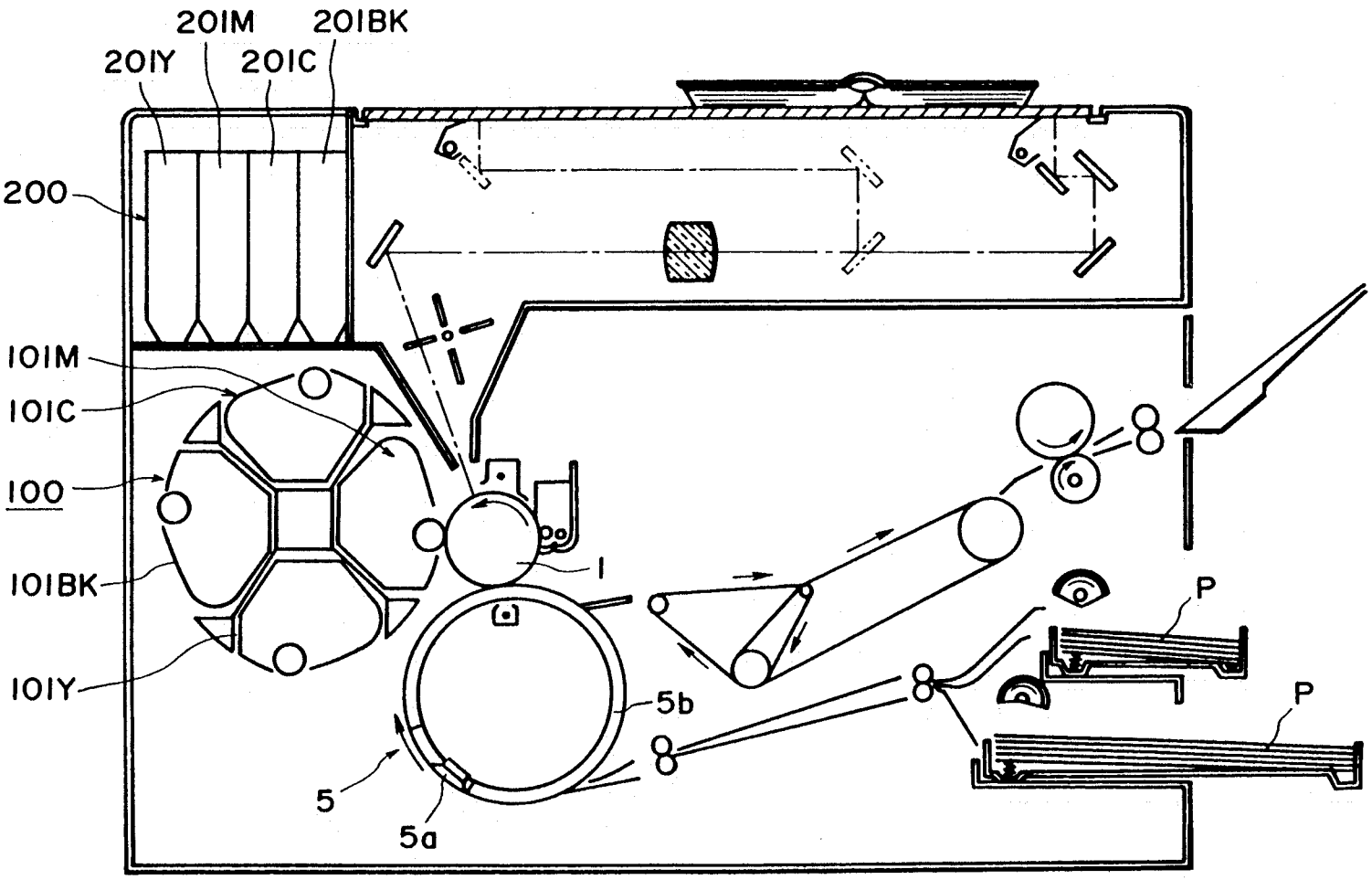
FIG. 11 is a sectional view of a conventional full-color copying apparatus having a rotatable developing apparatus.

Referring to FIG. 8, a further embodiment of the present invention will be described. FIG. 8 is a perspective view of a major part as seen from the rear upper position. The other portions are omitted for simplicity.

In FIG. 8, four developing units are disposed below the photosensitive drum 1, but the developing unit other than shown are omitted for simplicity. The developer container 106 is provided with developer scatter preventing member 109 at both sides of the developing sleeve 102. Corresponding to the scatter preventing members 109, abutment members 200 are provided at the respective sides of the photosensitive drum 1.

At a side of the developing unit, there is a duct 140 to suck the air between the developing sleeve 102 and the photosensitive drum 1 by a fan (not shown). The sucked air is discharged to the outside of the apparatus through an unshown toner filter in the duct 140.

With this structure, the toner and carrier particles scattered from the developing sleeve 102 during the developing operation are not only prevented from scattering to the adjacent developing unit but also are efficiently directed to the duct along the length of the developing unit through a closed passage defined by the developing sleeve 102, the top surface of the developer container 106, the developer scatter preventing member 109 and the abutment member 200.

When one or more of the used developing units are such that the toner or the carrier particles are easily scattered because of the arrangement of the magnetic poles, T/C ratio, the temperature/humidity condition and/or others, the color mixture between adjacent developing units can be prevented to a certain extent in the embodiment described in conjunction with FIG. 1. However, there is a liability that the scattered toner is accumulated on the top surface of the developing unit, which may fall when the developing unit is moved or when the developing unit is dismounted for the maintenance thereof. According to this embodiment, however, the scattered toner can be efficiently corrected at all times, and therefore, the toner is not liable to be accumulated on the top surface of the developing unit, and therefore, this embodiment is free from such a problem.

As compared with the structure wherein the developer scattered around the developing unit is sucked by the duct without the provision of the combination of the scatter preventing member 109 and the abutment member 200, the apparatus of this embodiment is capable of sucking the toner with low speed air flow using a small size fan, so that the cost and the required space can be reduced. When the scattered toner is corrected by high speed air flow, the toner may be scattered more against the intention, but the problem does not arise in this embodiment.

The advantageous effects can be provided most when the scatter preventing member 109 is provided at each side of the developer container 106. However, even if it is only at one side of the developer container 106, a U-shaped passage is defined, so that significant advantages can be provided.

In the foregoing embodiments, the image forming apparatus has been a full-color electrophotographic copying machine. However, the present invention is applicable to a multi-color copying machine having plural developing units.

In the foregoing embodiment, the developer scatter preventing member 109 is contacted to the abutment member (200, 211, 212). However, the present invention is not limited to this, but, as shown in FIG. 1 (109'), a small clearance may be provided between the preventing member 109 and the abutment member to provide substantial closure. In this case, however, the clearance is about 1 mm to provide the advantageous effects.

The present invention is particularly effective to the plural developing units movable along a line, but the direction of the movement is not limited to the horizontal direction.

As described in the foregoing, according to the present invention, the developer scatter preventing member is provided at least one of the upstream or downstream of the developing sleeve when the developing unit is at its operating position in the vicinity of the image bearing member, and the preventing member is contacted or close to a member provided adjacent the image bearing member, so that the toner or carrier particles scattered from the developing sleeve are prevented from moving into the adjacent developing unit. Therefore, the color mixture can be prevented, and the image quality is improved in the color reproducibility and color stabilization.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

an image bearing means;

means for forming a latent image on said image bearing means;

developing means for developing the latent image formed on said image bearing means, said developing means including plural developing units, each of said developing units including a developer carrying member movable to carry thereon the developer to supply the developer to said image bearing means and a developer scatter preventing member at a position adjacent said developer carrying member;

means for moving a selected one of said developing units to an operating position for a developing operation, wherein the operating position is common for all said developing units; and an abutment member adjacent said image bearing means and which is contacted to or close to the developer scatter preventing member of a selected developing unit when the selected developing unit is placed at the operating position, wherein said abutment member is common for all of said plural developing units, and wherein said abutment member and the scatter preventing member of said selected developing unit at the operating position cooperate to prevent movement of the developer to an adjacent developing unit.

2. An apparatus according to claim 1, wherein said plural developing units are movable along a line relative to said image bearing member.

3. An apparatus according to claim 2, wherein said developing units are pivotable about respective axes to be placed at the operating position.

4. An apparatus according to claim 2, wherein said plural developing units are movable in a horizontal plane.

5. An apparatus according to claim 1, wherein said developing means is disposed below said image carrying means.

6. An apparatus according to claim 1, wherein said plural developing units contain different color developers.

7. An apparatus according to claim 6, wherein said image forming apparatus forms a full-color image.

8. An apparatus according to claim 7, further comprising means for supplying an image receiving material to an image transfer position, and means for transferring a developed image from said image carrying means onto the image receiving material, wherein plural developed images are transferred onto the same transfer material.

9. An apparatus according to claim 8, wherein said means for conveying the image receiving material is disposed above said developing means.

10. An apparatus according to claim 1, wherein said developer scatter preventing member and said abutment member are disposed downstream of a developing zone with respect to a movement direction of said developer carrying member.

11. An apparatus according to claim 1, wherein said developer scatter preventing member and said abutment member are disposed at each of an upstream and a downstream side of a developing zone with respect to a movement direction of said developer carrying member.

12. An apparatus according to any one of claims 1, 10 or 11, wherein said developer scatter preventing member and said abutment member extend along a length of said developer carrying member.

13. An apparatus according to claim 12, wherein said developer scatter preventing member and said abutment member project from said developing unit toward said image carrying means.

14. An apparatus according to claim 1, wherein each said developer scatter preventing member comprises an elastic sheet.

15. An apparatus according to claim 1, wherein air flow is established along a length of said developer carrying member in a space defined by said image bearing means, said abutment member, and the developer scatter preventing member of the selected developing unit.

16. An apparatus according to claim 1, wherein said developing unit is provided with spacer means at opposite longitudinal ends of said developer carrying member to maintain a predetermined clearance between said image carrying means and said developer carrying member when said developing unit is placed at the operating position.

17. An apparatus according to claim 1, wherein said plural developing units are supported on a common supporting member.

18. An image forming apparatus, comprising:

an image bearing means;

means for forming an electrostatic latent image on said image bearing means;

developing means for developing the latent image formed on said image bearing means, said developing means including plural developing units containing different color developers, and movable supporting means for supporting said developing units along a line, wherein each of the developing units includes a developer carrying member to carry thereon the developer to supply the developer to said image bearing means and a developer scatter preventing member at a position adjacent the developer carrying member;

driving means for moving the supporting means along the line;

means for positioning a selected one of said developing units to an operating position for a developing operation, the operating position being common for all said developing units;

an abutment member adjacent said image bearing means, and which is contacted to or close to the developer scatter preventing member of a selected developing unit when the selected developing unit is placed at the operating position, said abutment member being common for all said plural developing units; and wherein said second developer scatter preventing member and the developer scatter preventing member of said selected developing unit at the operating position cooperate to prevent movement of the developer to an adjacent developing unit.

19. An apparatus according to claim 18, wherein said developer scatter preventing member and said abutment member extend along a length of said developer carrying member.

20. An apparatus according to claim 19, wherein each said developer scatter preventing member comprises an elastic sheet.

21. An apparatus according to claim 18, further comprising means for sucking air from a space defined by said developing unit disposed at the operating position, the developer scatter preventing member of said developing unit disposed at the operating position, the developer carrying member, said abutment member, and said image bearing member.

22. An apparatus according to claim 18, wherein said supporting means is reciprocable along the a straight line.

* * * * *

UNITED STATES PATENT AND TRADEMARK OFFICE

CERTIFICATE OF CORRECTION

PATENT NO. : 5,172,165

DATED : December 15, 1992

INVENTOR(S) : HATAKEYAMA ET AL.

It is certified that error appears in the above-indentified patent and that said Letters Patent is hereby corrected as shown below:

COLUMN 1

Line 37, "a" should read --and a--.

COLUMN 2

Line 12, "prevents" should read --prevent--.

COLUMN 6

Line 51, "lack" should read --rack--.

COLUMN 8

Line 23, "unit" should read --units--.

COLUMN 12

Line 5, "second developer scatter preventing" should read --abutment--.

UNITED STATES PATENT AND TRADEMARK OFFICE

CERTIFICATE OF CORRECTION

PATENT NO. : 5,172,165
DATED : December 15, 1992
INVENTOR(S) : Hatakeyama, et. al.

It is certified that error appears in the above-indentified patent and that said Letters Patent is hereby corrected as shown below:

Line 25, "the" should be deleted.

Signed and Sealed this

Twenty-second Day of February, 1994

*Attest:*

Bruce Lehman

BRUCE LEHMAN

*Attesting Officer*

*Commissioner of Patents and Trademarks*